US009279382B2

(12) United States Patent
Genko

(10) Patent No.: US 9,279,382 B2
(45) Date of Patent: Mar. 8, 2016

(54) VEHICLE AND CONTROL METHOD OF VEHICLE

(71) Applicant: Takeshi Genko, Toyota (JP)

(72) Inventor: Takeshi Genko, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 245 days.

(21) Appl. No.: 14/036,963

(22) Filed: Sep. 25, 2013

(65) Prior Publication Data

US 2014/0107909 A1 Apr. 17, 2014

(30) Foreign Application Priority Data

Oct. 16, 2012 (JP) ..... 2012-228871

(51) Int. Cl.

| | |
|---|---|
| ***F02D 43/04*** | (2006.01) |
| ***F02D 41/12*** | (2006.01) |
| ***F02D 41/14*** | (2006.01) |
| ***F02D 41/22*** | (2006.01) |

(52) U.S. Cl.

CPC ..... *F02D 43/04* (2013.01); *F02D 41/123* (2013.01); *F02D 41/1454* (2013.01); *F02D 41/1474* (2013.01); *F02D 41/1495* (2013.01); *F02D 41/222* (2013.01); *Y10S 903/902* (2013.01)

(58) Field of Classification Search

CPC ..... F02D 41/1454; F02D 41/1459; F02D 41/222; G01N 27/419

USPC ..... 701/101–103, 108, 109, 112–114; 123/179.4, 198 DB, 688, 690; 73/23.32, 73/114.74

See application file for complete search history.

(56) References Cited

U.S. PATENT DOCUMENTS

| | | | | |
|---|---|---|---|---|
| 5,769,063 | A * | 6/1998 | Mizusawa | 123/688 |
| 5,781,878 | A * | 7/1998 | Mizoguchi et al. | 701/109 |
| 5,834,624 | A * | 11/1998 | Nakagawa | 73/23.32 |
| 5,901,691 | A | 5/1999 | Katoh | |
| 5,925,088 | A * | 7/1999 | Nasu | 701/103 |
| 6,453,720 | B1 * | 9/2002 | Tomisawa | 73/1.06 |
| 6,901,741 | B2 * | 6/2005 | Kobayashi et al. | 60/274 |
| 7,013,214 | B2 * | 3/2006 | Ohsaki | 701/114 |
| 7,278,394 | B2 * | 10/2007 | Okazaki et al. | 123/305 |
| 7,415,343 | B2 * | 8/2008 | Zushi et al. | 701/101 |
| 7,874,285 | B2 * | 1/2011 | Barnikow et al. | 123/688 |
| 2008/0276698 | A1 | 11/2008 | Toya | |
| 2010/0076635 | A1 * | 3/2010 | Sugimoto | 701/22 |

FOREIGN PATENT DOCUMENTS

| | | |
|---|---|---|
| JP | A-10-54285 | 2/1998 |
| JP | A-11-218045 | 8/1999 |
| JP | A-2005-30358 | 2/2005 |
| JP | A-2008-95627 | 4/2008 |
| JP | A-2008-169749 | 7/2008 |

(Continued)

*Primary Examiner* — John Kwon
*Assistant Examiner* — Johnny H Hoang
(74) *Attorney, Agent, or Firm* — Oliff PLC

(57) ABSTRACT

A vehicle includes an internal combustion engine, an air-fuel ratio sensor provided in an exhaust passage of the internal combustion engine, and a controller. The controller is configured to diagnose a responsiveness of the air-fuel ratio sensor on the basis of an output voltage of the air-fuel ratio sensor in a predefined period. The period is a period over which exhaust gas goes through the air-fuel ratio sensor during the internal combustion engine is rotating without fuel injection.

8 Claims, 12 Drawing Sheets

(56) References Cited

FOREIGN PATENT DOCUMENTS

| | | |
|---|---|---|
| JP | A-2008-169776 | 7/2008 |
| JP | A-2010-7534 | 1/2010 |
| JP | A-2010-25090 | 2/2010 |
| JP | A-2012-026306 | 2/2012 |
| JP | A-2012-206306 | 2/2012 |
| JP | A-2012-57545 | 3/2012 |
| JP | A-2012-92719 | 5/2012 |

* cited by examiner

VEHICLE AND CONTROL METHOD OF VEHICLE

INCORPORATION BY REFERENCE

The disclosure of Japanese Patent Application No. 2012-228871 filed on Oct. 16, 2012 including the specification, drawings and abstract is incorporated herein by reference in its entirety.

BACKGROUND OF THE INVENTION

1. Field of the Invention

The invention relates to a vehicle and to a control method of a vehicle. More specifically, the invention relates to responsiveness diagnosis of an air-fuel ratio sensor that is installed in a vehicle.

2. Description of Related Art

Internal combustion engines are controlled on the basis of a detection value by an air-fuel ratio sensor that is disposed in an exhaust passage of the internal combustion engine. For example, there is a conventional control method in which a fuel injection amount is compensated on the basis of a detection value by an air-fuel ratio sensor, in such a manner that the air-fuel ratio of the internal combustion engine comes close to a stoichiometric air-fuel ratio.

Japanese Patent Application Publication No. 2008-95627 (JP-2008-95627 A) discloses an air-fuel ratio control device for internal combustion engines that has a function of compensating variability of an output characteristic derived from manufacturing tolerances, changes over time and so forth in an air-fuel ratio sensor. In JP-2008-95627 A, the supplied air-fuel ratio is deliberately altered periodically to richer or leaner ratios while the vehicle is traveling. An output characteristic compensation value of the air-fuel ratio sensor is calculated on the basis of a comparison between a change amount of the output of the air-fuel ratio sensor, and an oscillation width of the air-fuel ratio, arising from periodic changes in the supplied air-fuel ratio.

In JP-2008-95627 A, the air-fuel ratio must be modified according to the intended oscillation swing during operation of the internal combustion engine (during fuel combustion), with a view to detecting accurately the output characteristic of the air-fuel ratio sensor. However, the actual air-fuel ratio may fail to be modified as intended, due to the influence of combustion variability, and hence the output behavior of the air-fuel ratio sensor may in some instances fail to be accurately diagnosed. Moreover, the air-fuel ratio is modified during actual driving of the internal combustion engine. This may entail worse emissions as well as a poorer drivability on account of output fluctuations in the internal combustion engine.

SUMMARY OF THE INVENTION

The invention relates to a technology for diagnosing accurately a response characteristic of an air-fuel ratio sensor, without affecting the behavior of an internal combustion engine.

In a first aspect of the invention, a vehicle includes an internal combustion engine, an air-fuel ratio sensor provided in an exhaust passage of the internal combustion engine, and a controller. The control unit is configured to diagnose a responsiveness of the air-fuel ratio sensor on the basis of an output voltage of the air-fuel ratio sensor in a predefined period. The period is a period over which exhaust gas goes through the air-fuel ratio sensor during the internal combustion engine is rotating without fuel injection.

The vehicle further includes an electric motor that starts up the internal combustion engine. The controller is configured to perform control in such a manner that the internal combustion engine operates intermittently in accordance with a vehicle state while the vehicle is traveling. The controller may be configured to diagnose the responsiveness on the basis of the output voltage of the air-fuel ratio sensor in the predefined period corresponding to a period from the internal combustion engine is stopped to the fuel injection is initiated, when the internal combustion engine is started up by the electric motor from a state of being stopped while the vehicle is traveling.

The vehicle further includes an electric motor that starts up the internal combustion engine. The controller may be configured to diagnose the responsiveness on the basis of the output voltage of the air-fuel ratio sensor in the predefined period corresponding to a period from the internal combustion engine is started up to the fuel injection is initiated, upon startup of the internal combustion engine by the electric motor from a stopped state.

The vehicle further includes an angle acquisition device that acquires a crank angle at a time at which startup of the internal combustion engine is initiated. The controller may be configured to correct a result of diagnosis of the responsiveness obtained at the time of startup of the internal combustion engine, in accordance with the crank angle acquired by the angle acquisition device.

In the vehicle, the controller may be configured to diagnose the responsiveness on the basis of the output voltage of the air-fuel ratio sensor in the predefined period corresponding to a period over which the fuel injection of the internal combustion engine is discontinued while the vehicle is traveling.

In the vehicle, the controller may be configured to calculate, upon diagnosis of the responsiveness, at least any one of a locus length, an average slope, a maximum slope and an integrated value, of the output voltage of the air-fuel ratio sensor in the predefined period, as a parameter that denotes the responsiveness.

In the vehicle, the controller may be configured to calculate, as the parameter, the integrated value of the output voltage, in a case where an initial voltage, being an output voltage of the air-fuel ratio sensor obtained at the time at which diagnosis of the responsiveness is initiated, lies within a first voltage range. The controller may be configured to calculate, as the parameter, the locus length of the output voltage in a case where the initial voltage lies outside the first voltage range.

In the vehicle, the controller may be configured to diagnose the responsiveness when a predefined condition is met upon initiation of the diagnosis, and to modify the predefined condition in accordance with a history up to a previous result of diagnosis of the responsiveness.

In the vehicle, the controller may be configured to calculate, upon diagnosis of the responsiveness, at least any one of a locus length, an average slope, a maximum slope and an integrated value, of the output voltage of the air-fuel ratio sensor in the predefined period, as a parameter that denotes the responsiveness, and the controller may be configured to modify the calculated parameter in accordance with a history up to a previous result of diagnosis of the responsiveness.

In the vehicle, the controller may be configured to execute diagnosis of the responsiveness in a case where an initial voltage, lies within a given voltage range, the initial voltage is an output voltage of the air-fuel ratio sensor obtained at the time at which diagnosis of the responsiveness is initiated and the controller may be configured to select, as the given voltage range, any one of a first voltage range and a second voltage range that is wider than the first voltage range, in accordance with a history up to a previous result of diagnosis of the responsiveness. The controller may be configured to calculate, as the parameter, the integrated value of the output voltage when the first voltage range is set to the given voltage range, and to calculate, as the parameter, the locus length of the output voltage when the second voltage range is set to the given voltage range.

In a second aspect of the invention, a method for controlling a vehicle includes diagnosing a responsiveness of an air-fuel ratio sensor on the basis of an output voltage of the air-fuel ratio sensor in a predefined period, the period is a period over which exhaust gas goes through the air-fuel ratio sensor during an internal combustion engine is rotating without fuel injection.

The invention allows diagnosing accurately a response characteristic of an air-fuel ratio sensor, without affecting the behavior of an internal combustion engine.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
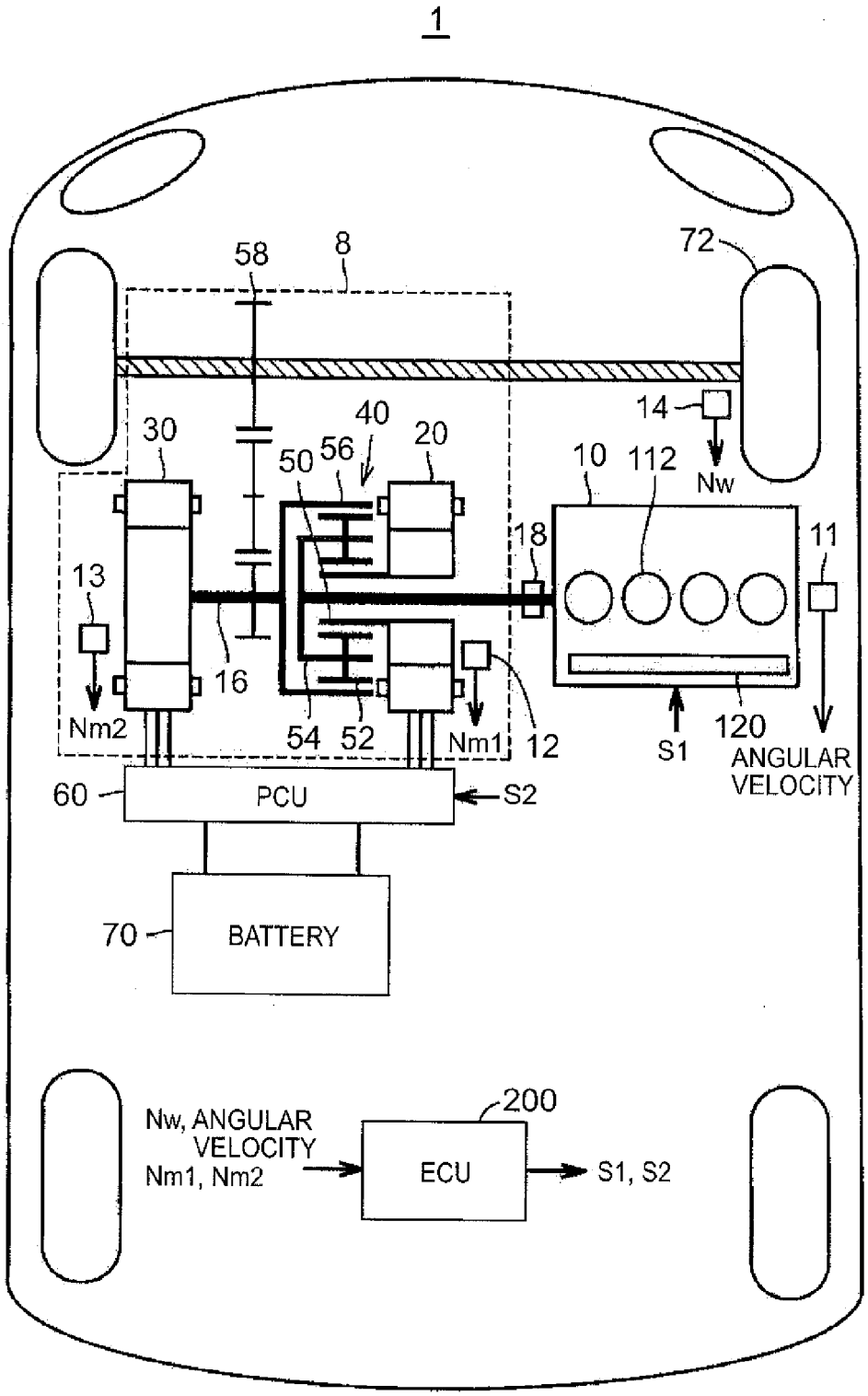
FIG. 1 is a block diagram for explaining the configuration of a hybrid vehicle 1 that is illustrated as a typical example of a vehicle according to Embodiment 1 of the invention.

Embodiments of the invention will be explained next in detail with reference to accompanying drawings. In the explanation below, identical or equivalent portions in the figures will be denoted by identical reference numerals, and a recurrent explanation thereof will be omitted.

Embodiment 1 is explained next. FIG. 1 is a block diagram illustrating a typical example of a vehicle according to Embodiment 1 of the invention, for the purpose of explaining the configuration of a hybrid vehicle 1.

The entire block diagram of the hybrid vehicle 1 according to the present Embodiment 1 (hereafter, vehicle 1 for short) will be explained with reference to FIG. 1. The vehicle 1 is provided with a transmission 8, an engine 10, a torsional damper 18, a power control unit (PCU) 60, a battery 70, drive wheels 72, and an electronic control unit (ECU: can be regarded as a controller) 200.

The transmission 8 is provided with a drive shaft 16, a first motor generator (hereafter notated as first MG) 20, a second motor generator (hereafter, notated as second MG) 30, a power split mechanism 40, and a speed reducer 58.

The vehicle 1 travels by virtue of the driving force that is outputted by at least one of the engine 10 and the second MG 30. The motive power generated by the engine 10 is split into two pathways by the power split mechanism 40. One of the two pathways is a pathway of transmission to the drive wheels 72 via the speed reducer 58; the other pathway is a pathway of transmission to the first MG 20.

The first MG 20 and the second MG 30 are, for instance, three-phase alternating current (AC) rotating electrical machines. The first MG 20 and the second MG 30 are driven by the PCU 60.

The first MG 20 functions as a generator that generates electric power using motive power of the engine 10 that is split by the power split mechanism 40. The first MG 20 receives electric power from the battery 70 and rotates a crankshaft that is an output shaft of the engine 10. Accordingly, the first MG 20 functions as a starter that starts of the engine 10.

A first resolver 12 is provided in the first MG 20. The first resolver 12 detects a rotational speed Nm1 of the first MG 20. The first resolver 12 transmits a signal that denotes the detected rotational speed Nm1, to the ECU 200.

The second MG 30 functions as a motor for travel that applies a driving force to the drive wheels 72 using at least one of electric power stored in the battery 70 and electric power generated by the first MG 20. The second MG 30 functions as a generator for charging the battery 70, by way of the PCU 60, using electric power that is generated as a result of regenerative braking.

A second resolver 13 is provided in the second MG 30. The second resolver 13 detects a rotational speed Nm2 of the second MG 30. The second resolver 13 transmits a signal that denotes the detected rotational speed Nm2, to the ECU 200.

The engine 10 is for instance an internal combustion engine such as a gasoline engine or a diesel engine. A crank position sensor 11 is provided at a position, in the engine 10, opposite the crankshaft. The crank position sensor 11 detects the rotation angle and angular velocity of the crankshaft of the engine 10. The crank position sensor 11 transmits a signal that denotes the detected rotation angle and angular velocity, to the ECU 200. The ECU 200 calculates a rotational speed Ne of the engine 10 on the basis of the received angular velocity.

The torsional damper 18 is provided between the crankshaft of the engine 10 and an input shaft of the transmission 8. The torsional damper 18 absorbs torque fluctuations during transmission of motive power between the crankshaft of the engine 10 and the input shaft of the transmission 8.

The power split mechanism 40 is a motive power transmission device that mechanically connects three elements, namely the drive shaft 16 that is connected to the drive wheels 72, the output shaft of the engine 10, and a rotating shaft of the first MG 20. By using any one of the above-described three elements as a reaction force element, the power split mechanism 40 is capable of transmitting motive power between the other two elements. A rotating shaft of the second MG 30 is connected to the drive shaft 16.

The power split mechanism 40 is a planetary gear mechanism that includes a sun gear 50, pinion gears 52, a carrier 54 and a ring gear 56. The pinion gears 52 mesh with the sun gear 50 and the ring gear 56. The carrier 54, which rotatably supports the pinion gears 52, is connected to the crankshaft of the engine 10. The sun gear 50 is connected to the rotating shaft of the first MG 20. The ring gear 56 is connected to the speed reducer 58 and the rotating shaft of the second MG 30 via the drive shaft 16.

The speed reducer 58 transmits, to the drive wheels 72, motive power from the power split mechanism 40 and the second MG 30. The speed reducer 58 transmits a reaction force from the road surface, received by the drive wheels 72, to the power split mechanism 40 and the second MG 30.

A wheel speed sensor 14 detects a rotational speed Nw of the drive wheels 72. The wheel speed sensor 14 transmits, to the ECU 200, a signal that denotes the detected rotational speed Nw. The ECU 200 calculates a speed V of the vehicle 1 on the basis of the received rotational speed Nw. The ECU 200 may calculate the speed V of the vehicle 1 on the basis of the rotational speed Nm2 of the second MG 30, instead of on the basis of the rotational speed Nw.

Figure 2:
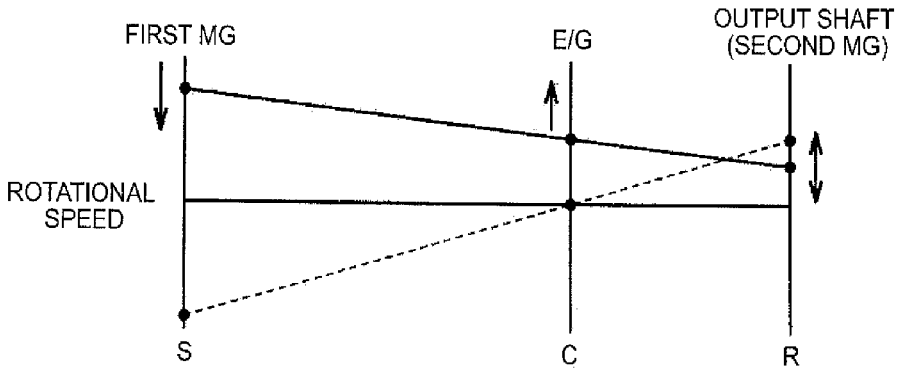
FIG. 2 is a collinear diagram of a power split mechanism, illustrated in FIG. 1, according to Embodiment 1.

FIG. 2 illustrates a collinear diagram of the power split mechanism 40. With reference to FIG. 2, when a reaction force torque from the first MG 20 is inputted to the sun gear (S) 50, for the output torque of the engine 10 that is inputted to the carrier (C) 54, a torque having magnitude corresponding to the addition and subtraction of the foregoing two torques acts on the ring gear (R) 56 that constitutes an output element. In this case, the rotor of the first MG 20 rotates on account of that torque. The first MG 20 functions thus as a power generator. In a ease where the rotational speed (output rotational speed) of the ring gear 56 is set to be constant, the rotational speed of the engine 10 can be continuously (steplessly) modified by changing the magnitude of the rotational speed of the first MG 20. Specifically, control whereby the rotational speed of the engine 10 is set for instance to a rotational speed of good fuel economy can be thus achieved through control of the first MG 20. Such rotational speed control is achieved through control of the first MG 20 by the ECU 200.

With reference again to FIG. 1, the PCU 60 converts direct current (DC) electric power that is stored in the battery 70 to AC electric power for driving the first MG 20 and the second MG 30. The PCU 60 includes a converter and an inverter (neither shown) that are controlled on the basis of a control signal S2 from the ECU 200. The converter boosts the voltage of the DC electric power received from the battery 70, and outputs the boosted voltage to the inverter. The inverter converts the DC electric power, outputted by the converter, to AC electric power, and outputs the AC electric power to the first MG 20 and/or the second MG 30.

As a result, the first MG 20 and/or the second MG 30 is/are driven using the electric power stored in the battery 70. The inverter converts, to DC electric power, AC electric power that is generated by the first MG 20 and/or the second MG 30, and outputs the DC electric power to the converter. The converter steps down the voltage of the DC electric power outputted by the inverter, and outputs the voltage to the battery 70. As a result, the battery 70 is charged using the electric power that is generated by the first MG 20 and/or the second MG 30. The converter may be omitted.

The battery 70, which is an electric storage device, is a rechargeable DC power source. A secondary battery such as a nickel hydride battery or a lithium ion battery is used as the battery 70. The voltage of the battery 70 is for instance about 200 V. The battery 70 may be charged using the electric power generated by the first MG 20 and/or the second MG 30 as described above, or using electric power that is supplied from an external power source (not shown). The battery 70 is not limited to a secondary battery, and may be for instance a capacitor, a solar cell, a fuel cell or the like that is capable of generating DC voltage. A charging device capable of charging the battery 70 using an external power source may be installed in the vehicle 1.

The ECU 200 generates a control signal S1 for controlling the engine 10, and outputs the generated control signal S1 to the engine 10. The ECU 200 generates a control signal S2 for controlling the PCU 60, and outputs the generated control signal S2 to the PCU 60.

Through control of the engine 10, the PCU 60 and so forth, the ECU 200 controls the entire hybrid system in such a manner that the vehicle 1 can travel in efficient manner. That is, the ECU 200 controls the charge and discharge state of the battery 70, and the operational state of the engine 10, the first MG 20 and the second MG 30.

The ECU 200 calculates a request driving power that corresponds to the depression amount of an accelerator pedal (not shown) that is provided in the driver's seat side. For instance, the ECU 200 calculates the request driving power in the form of a function of the accelerator operation amount and vehicle speed.

The ECU 200 controls the torques of the first MG 20 and the second MG 30, and the output of the engine 10, in accordance with the calculated request driving power. The ECU 200 controls the vehicle 1 so that the latter travels by virtue of the second MG 30 alone if the efficiency of the engine 10 is poor, for instance when the vehicle starts moving or when the vehicle travels in low-speed.

During normal travel, the ECU 200 starts the engine 10 in accordance with the state of the vehicle 1. For instance, the ECU 200 stops the engine 10 when the request driving power in the vehicle 1 is lower than a threshold value. Conversely, the ECU 200 starts the engine 10 when the request driving power exceeds a threshold value. The engine 10 is thus intermittently stopped and started during travel of the vehicle 1. Upon stop of the engine 10, the vehicle 1 can travel forward in a state where the rotational speed of the first MG 20 is negative and the rotational speed of the second MG 30 is positive, with engine rotational speed=0, as denoted by the dotted line of the collinear diagram of FIG. 2.

During operation of the engine 10, the motive power of the engine 10 is split into two pathways by the power split mechanism 40. The drive wheels 72 are directly driven by Motive power of one path, and power is generated through driving of the first MG 20 by motive power of the other path. The ECU 200 drives then the second MG 30 using the generated electric power. Driving of the second MG 30 affords auxiliary drive of the drive wheels 72.

Figure 3:
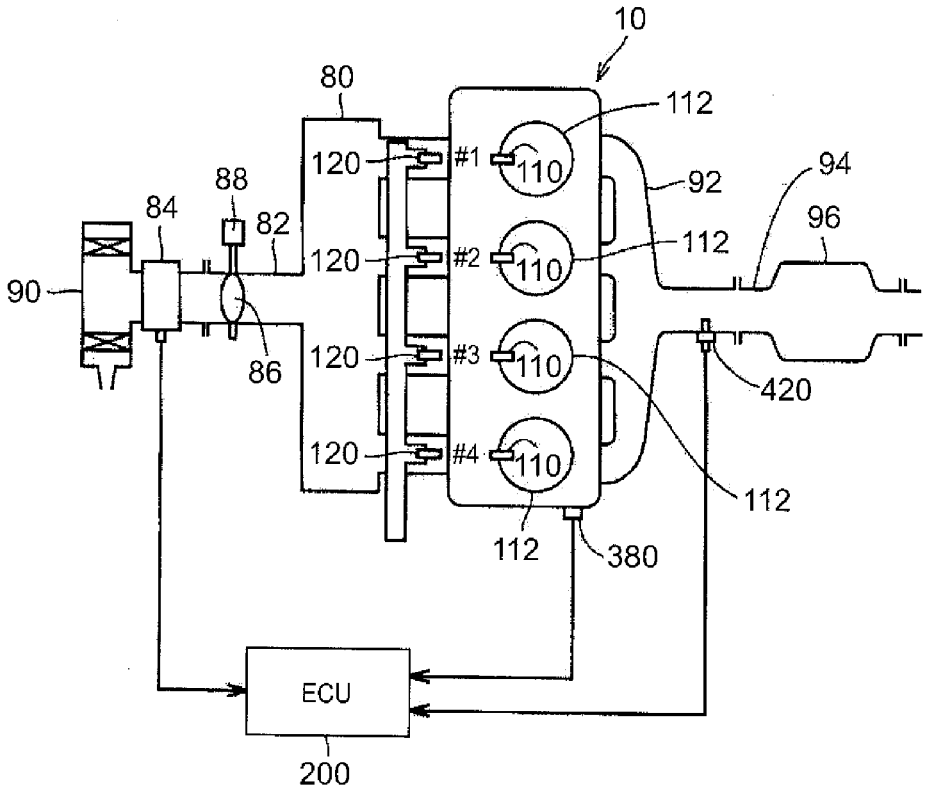
FIG. 3 is a schematic diagram for further explaining the configuration of an engine, illustrated in FIG. 1, according to Embodiment 1.

The configuration of the engine will be explained next in further detail based on FIG. 3. In FIG. 3, the engine 10 is provided with, for instance, four cylinders 112, from cylinder #1 to cylinder #4. A respective spark plug 110 is provided at the head of each cylinder 112. The engine 10 is not limited to an inline four-cylinder engine such as the one illustrated in FIG. 1 and FIG. 2, and may be for instance a V-type six-cylinder engine, a V-type eight-cylinder engine, or an inline six-cylinder engine.

An intake manifold 80 is connected to the intake side of the engine 10. An end of an intake pipe 82 is connected to the upstream side of the intake manifold 80. The intake pipe 82 is provided with an air flow meter 84, a throttle valve 86, a throttle motor 88 and an air cleaner 90. The air flow meter 84 detects an intake air amount of the engine 10.

The throttle valve 86 adjusts the intake air amount. The throttle motor 88 drives the throttle valve 86 on the basis of a control signal from the ECU 200. The air cleaner 90 is connected to the other end of the intake pipe 82, on the side opposite to the end at which the intake pipe 82 is connected to the engine.

The intake manifold 80 is branched on the downstream side, the branches being connected to respective cylinders 112. Respective fuel injection devices 120 are provided for the cylinders 112, at points from the branching point of the intake manifold 80 up to the plurality of cylinders 112. Each fuel injection device 120 is provided in a respective cylinder 112.

An exhaust manifold 92 is connected to the exhaust side of the engine 10. The exhaust manifold 92 is branched on the upstream side, such that each branch is connected to a respective exhaust port of each cylinder 112. An exhaust pipe 94 is connected to a merging portion on the downstream side of the exhaust manifold 92. An air-fuel ratio sensor 420 is provided in the exhaust pipe 94. A three-way catalytic converter 96 for exhaust gas purification is provided further downstream than the air-fuel ratio sensor 420 of the exhaust pipe 94.

A water temperature sensor 380 detects the temperature of cooling water that goes through the interior of the engine 10. The water temperature sensor 380 transmits, to the ECU 200, a signal that denotes the cooling water temperature.

The air-fuel ratio sensor 420 is a sensor for detecting the air-fuel ratio of an air-fuel mixture of fuel and air that are supplied to the plurality of cylinders 112. In the present embodiment, the air-fuel ratio sensor 420 is a wide-range air-fuel ratio sensor (linear air-fuel ratio sensor) that generates an output current that is proportional to the air-fuel ratio of the air-fuel mixture that is burned in the engine 10. Specifically, the air-fuel ratio sensor 420 generates an output current that is proportional to the oxygen concentration in the exhaust gas, such that voltage that is proportional to the output current of the air-fuel ratio sensor 420 is inputted to the ECU 200. This voltage will be referred to hereafter as an output voltage Vaf of the air-fuel ratio sensor 420. The ECU 200 can detect the air-fuel ratio of the air-fuel mixture in each cylinder 112 at which combustion takes place, in a predefined order, on the basis of the rotation angle of the crankshaft of the engine 10 as detected by the crank position sensor 11 and on the basis of the detection value by the air-fuel ratio sensor 420.

Figure 4:
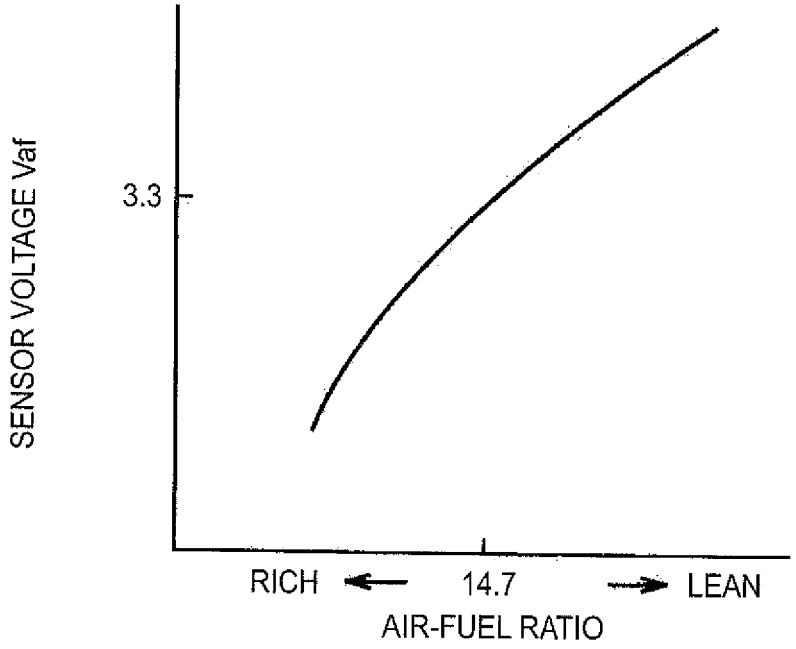
FIG. 4 is a conceptual diagram for explaining an output characteristic of an air-fuel ratio sensor, illustrated in FIG. 3, according to Embodiment 1.

FIG. 4 is a conceptual diagram illustrating an output characteristic of the air-fuel ratio sensor 420. With reference to FIG. 4, the air-fuel ratio sensor 420 is configured to be capable of linearly detecting an air-fuel ratio over a wide range that encompasses a stoichiometric air-fuel ratio (14.7). For instance, the output voltage Vaf of the air-fuel ratio sensor 420 (hereafter also referred to as sensor voltage Vaf) is Vaf=3.3 V for a stoichiometric air-fuel ratio. The value of Vaf increases as the air-fuel ratio becomes leaner, and decreases as the air-fuel ratio becomes richer.

With reference again to FIG. 3, the ECU 200 of the engine 10 controls the fuel injection amount in each of the plurality of cylinders 112. That is, the ECU 200 injects an appropriate amount of fuel to each of the plurality of cylinders 112, or discontinues injection of fuel to the plurality of cylinders 112, at appropriate timings. The fuel injection amount is basically computed in such a manner that the air-fuel ratio determined by the fuel injection amount for the intake air amount takes on a target value (typically, a stoichiometric air-fuel ratio).

Herein, compensation control of the fuel injection amount is executed on the basis of the detection value of the air-fuel ratio sensor 420. Specifically, there is executed feedback control of the air-fuel ratio such that the fuel injection amount is increased if the air-fuel ratio detected by the air-fuel ratio sensor 420 is leaner than a target value, and is reduced if the detected air-fuel ratio is richer than a target value. Therefore, in order to stabilize the combustion state in the engine 10, the detection value by the air-fuel ratio sensor 420 is needed to be accurate. Accordingly, it is important to diagnose whether the output of the air-fuel ratio sensor 420 is normal or not.

In the vehicle according to the present embodiment, the responsiveness of the air-fuel ratio sensor 420 is diagnosed on the basis of the output voltage Vaf upon detection, by the air-fuel ratio sensor 420, of exhaust at a period during which the engine 10 is rotating without fuel injection (the engine 10 is rotating with fuel injection in a discontinued state). It is expected that, in this case, the air-fuel ratio in exhaust from the engine 10 changes significantly from a value up to discontinuation of fuel injection (i.e. a value close to the stoichiometric air-fuel ratio) to a leaner value, through introduction of new air in the state where fuel injection is discontinued. That is, responsiveness diagnosis of the air-fuel ratio sensor 420 can be executed by detecting whether or not the sensor voltage Vaf oscillates normally towards the lean side at this time.

Occurrences of periods where the engine 10 is rotating with fuel injection in a discontinued state include, for instance, engine startup.

Figure 5:
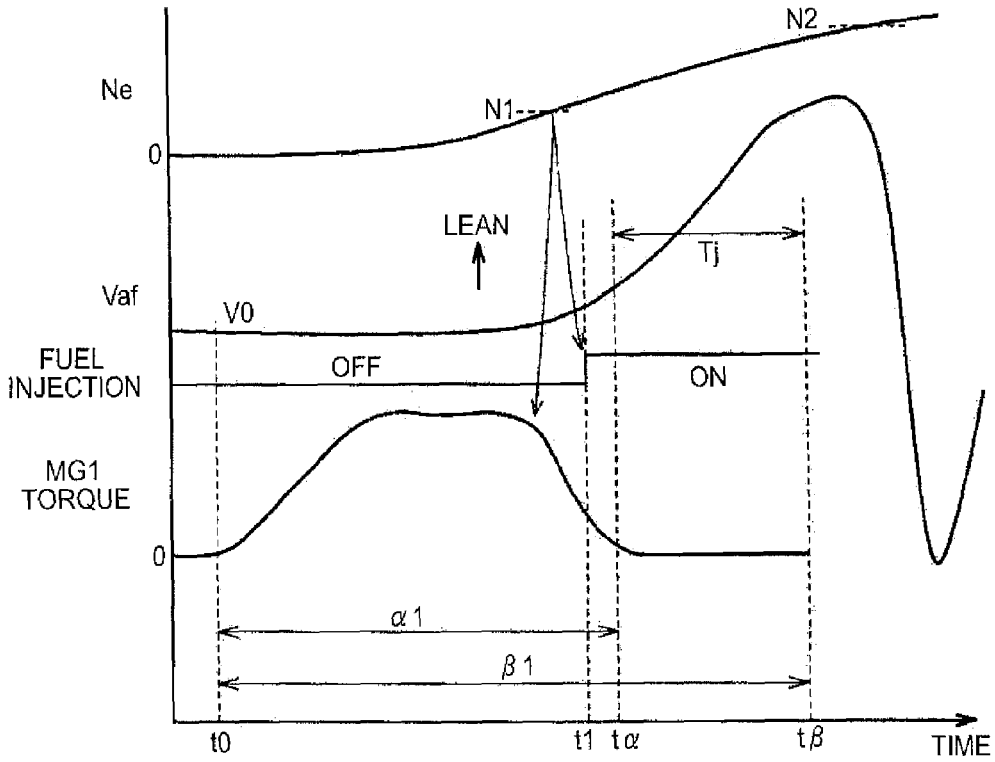
FIG. 5 is a first waveform diagram for explaining responsiveness diagnosis of an air-fuel ratio sensor according to Embodiment 1.

FIG. 5 is a first waveform diagram for explaining responsiveness diagnosis of an air-fuel ratio sensor according to the present embodiment. FIG. 5 illustrates the behavior of the output voltage of the air-fuel ratio sensor at engine startup.

With reference to FIG. 5, startup of the engine 10 in a stopped state is initiated at time t0. At this point in time (time at which responsiveness diagnosis starts) there holds sensor voltage Vaf=V0.

At engine startup, the engine 10 of the hybrid vehicle 1 is motored by the first MG 20 in a state where fuel injection is kept cutoff. The engine rotational speed Ne rises as a result. At time t1, the engine rotational speed exceeds a threshold value N1, and in response to thereto, the output torque that is transmitted from the first MG 20 to the engine is lowered, and fuel injection is initiated at the engine 10. As a result, the engine rotational speed increases further, and when the engine rotational speed exceeds a reference value N2, full combustion of the engine 10 is detected, whereby engine startup is complete.

At the period from time t0 to t1, air is introduced into combustion chambers with fuel injection in a discontinued state in the engine 10. As a result, the air-fuel ratio in the exhaust changes significantly towards a leaner ratio. Thereafter, the exhaust after fuel injection initiation (from time t1 onwards) changes so as to become richer. As this exhaust goes through the air-fuel ratio sensor 420, the sensor voltage Vaf changes significantly as a result towards a richer ratio.

Therefore, it becomes possible to diagnose whether or not the air-fuel ratio sensor 420 can detect a change of the air-fuel ratio to a leaner ratio on the basis of the behavior of the sensor voltage Vaf in a predefined period tα to tβ during which exhaust goes through the air-fuel ratio sensor 420, at the period of time t0 to t1. That is, a drop in the responsiveness of the air-fuel ratio sensor 420 can be detected to have occurred when the sensor voltage Vaf does not change properly during this period. The change in the air-fuel ratio during this period does not include fluctuations of the air-fuel ratio derived from combustion variability, as is the case in JP-2008-95627 A. Further, the air-fuel ratio changes significantly from a stoichiometric ratio (stoichiometric air-fuel ratio) towards a leaner one, and hence it becomes possible to diagnose the responsiveness of the air-fuel ratio sensor with yet higher precision.

The predefined period tα to tβ can be established according to elapsed times α1, β1 from the point in time at which engine startup is initiated (time t0). The elapsed times α1, β1 can be determined beforehand in accordance with the time lag until the exhaust from the engine 10 reaches the air-fuel ratio sensor 420. At engine startup, the behavior of the engine rotational speed Ne is fixed, and hence the predefined period tα to tβ can be set with good precision. At engine startup, the engine rotational speed Ne is at a low region, and hence the rate of change of the sensor voltage Vaf changes is gentler compared to that in a region of high engine rotational speed Ne.

The response diagnosis of air-fuel ratio sensor at engine startup illustrated in FIG. 5 can be executed at a first startup of the engine 10 after the vehicle starts being driven, and, in addition, at engine restart (intermittent startup) that accompanies the intermittent operation of the engine 10.

The response diagnosis of the air-fuel ratio sensor illustrated in FIG. 5 can be executed at engine startup (first startup) when the vehicle starts being driven (ignition switch on) also in an ordinary vehicle where an engine alone is installed as a driving force source. In an ordinary vehicle, the output of the electric motor that is disposed for engine startup is controlled in the same way as the output torque of the first MG 20 in FIG. 5.

In the case of a vehicle having an idle stop function, the engine 10 is operated intermittently accompanying stopping and restart of the vehicle during driving of the latter with the ignition switch still on. Therefore, the response diagnosis of the air-fuel ratio sensor can be executed, in the same way as during intermittent startup in a hybrid vehicle, also at engine restart from idle stop.

It is difficult to secure a change amount of the sensor voltage Vaf, and hence responsiveness diagnosis is difficult to execute properly, in a case where the initial value V0 of the sensor voltage Vaf at time t0 (hereafter, initial voltage V0), in FIG. 5, is already a lean-side value. In other words, response diagnosis of the air-fuel ratio sensor according to the present embodiment described above is needed to be executed when the initial voltage V0 lies in a given range in the vicinity of the stoichiometric air-fuel ratio.

Regarding this point, the initial voltage V0 during vehicle travel is likelier to lie within the abovementioned given range during intermittent startup (restart) of the engine 10 than at the first startup of the engine 10. The likelihood that the air-fuel ratio sensor 420 has already been activated is likewise higher at times of intermittent startup (restart) than at the first startup.

A period during which the engine 10 rotates with fuel injection in a discontinued state occurs as well in a vehicle where fuel cutoff is executed during vehicle travel.

Figure 6:
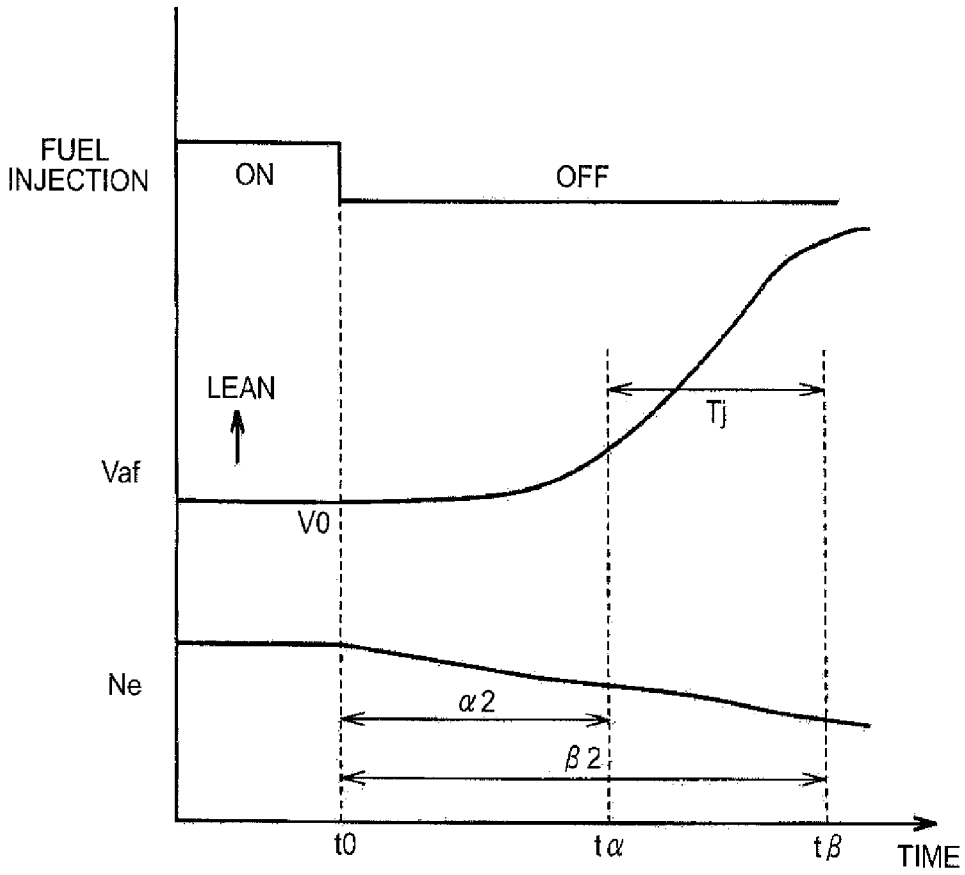
FIG. 6 is a second waveform diagram for explaining responsiveness diagnosis of an air-fuel ratio sensor according to Embodiment 1.

FIG. 6 is a second waveform diagram for explaining responsiveness diagnosis of an air-fuel ratio sensor according to the present embodiment. FIG. 6 illustrates the behavior of the output voltage of the air-fuel ratio sensor at the time of fuel cutoff initiation.

With reference to FIG. 6, fuel cutoff is initiated in response to a predefined fuel cutoff condition being met when the accelerator pedal is turned off during travel. The fuel cutoff condition includes, for instance, a condition whereby the engine rotational speed is higher than a predefined value. In FIG. 6, fuel injection is discontinued at time t0.

As a result, the engine 10 rotates in a state of discontinued fuel injection from time t0 onwards. During ongoing fuel cutoff, the sensor voltage Vaf increases significantly in response to the drop of the air-fuel ratio in the exhaust of the engine 10. By contrast, the engine rotational speed Ne drops gradually accompanying fuel cutoff.

Also in the state of FIG. 6, responsiveness diagnosis can be executed in the same way as explained for the case of FIG. 5 above, on the basis of the behavior of the sensor voltage Vaf in the predefined period tα to tβ during which exhaust goes through the air-fuel ratio sensor 420 in the period from time t0 onwards. As in the case of FIG. 5, the sensor voltage Vaf at the period tα to tβ of FIG. 6 does not include air-fuel ratio fluctuations due to combustion variability. Accordingly, it is possible to diagnose the responsiveness of the air-fuel ratio sensor with high precision.

The predefined period tα to tβ can be established according to elapsed times α2, β2 from the point in time of fuel cutoff initiation (time t0). The elapsed times α2, β2 can be determined beforehand in accordance with the time lag until the exhaust from the engine 10 reaches the air-fuel ratio sensor 420. Appropriate values of the elapsed times α2, β2 change in accordance with the engine rotational speed and the intake air amount at the time of fuel cutoff initiation. Preferably, therefore, a relationship between the engine rotational speed and appropriate values of the elapsed times α2, β2 is worked out beforehand, and the elapsed times α2, β2 are set beforehand in accordance with the engine rotational speed at the time of fuel cutoff initiation. The rate of change of the sensor voltage Vaf is comparatively high in responsiveness diagnosis in a state where the engine revolutions are high. In some instances, therefore, responsiveness diagnosis may be more difficult than responsiveness diagnosis at the time of engine startup.

Fuel cutoff can be executed both in a vehicle provided with an engine alone and in a hybrid vehicle. Therefore, responsiveness diagnosis of an air-fuel ratio sensor, illustrated in FIG. 6, can also be executed both in a vehicle provided with an engine alone and in a hybrid vehicle.

Thus, response diagnosis of an air-fuel ratio sensor in the vehicle according to the present embodiment can be executed, upon engine startup and upon fuel cutoff, both in a hybrid vehicle (for instance, the vehicle 1 illustrated in FIG. 1), and in a vehicle in which an engine alone is installed as a driving force source. In particular, responsiveness diagnosis can be suitably executed during intermittent startup of the engine, for instance during engine intermittent startup in a hybrid vehicle, and upon engine restart from idle stop in an ordinary vehicle.

Figure 7:
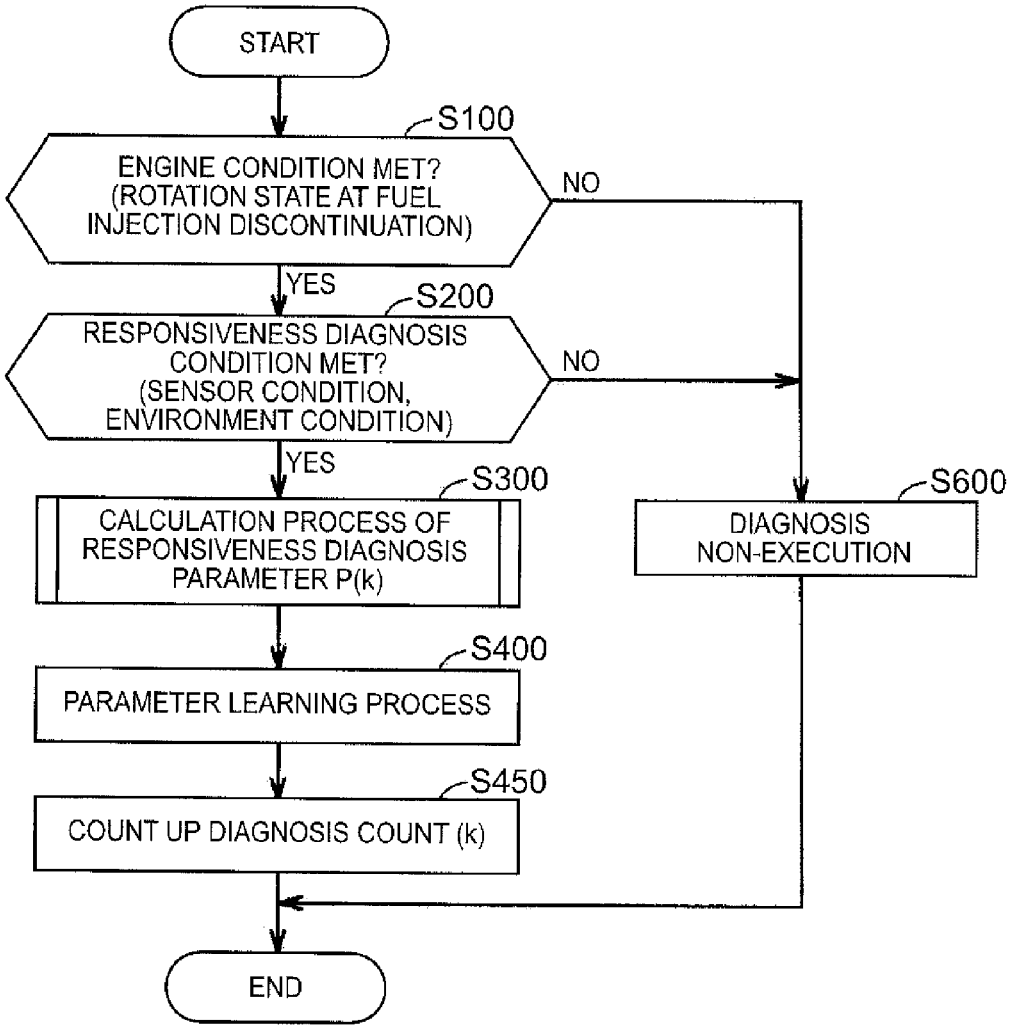
FIG. 7 is a flowchart illustrating a control process procedure for responsiveness diagnosis of an air-fuel ratio sensor according to Embodiment 1.

FIG. 7 is a flowchart illustrating a control process procedure for responsiveness diagnosis of an air-fuel ratio sensor according to the present Embodiment 1. The process illustrated in FIG. 7 is executed by the ECU 200 every predefined period.

With reference to FIG. 7, the ECU 200 determines, in step S100, whether an engine condition for execution of responsiveness diagnosis is met or not. Step S100 yields YES when there is met a condition whereby the engine 10 rotates with fuel injection in a discontinued state, as illustrated in the examples at the time of engine startup (FIG. 5) and fuel cutoff (FIG. 6). For instance, step S100 yields YES at time t0 in FIG. 5 and FIG. 6.

Step S100 may be set so that there is determined only part of the condition whereby the engine 10 rotates with fuel injection in a discontinued state, illustrated in FIG. 5 and FIG. 6. In a case where, for instance, precision of responsiveness diagnosis is given priority, step S100 may be set to yield YES only during intermittent startup of the engine. In a case where responsiveness diagnosis is no longer necessary; for instance because responsiveness diagnosis has already been sufficiently executed, step S100 may be set to yield NO at all times, regardless of the engine condition.

When the engine condition is met (YES in S100), the ECU 200 proceeds to step S200, and determines whether a condition for responsiveness diagnosis is met or not. For instance, the ECU 200 determines, in step S200, whether or not the air-fuel ratio sensor 420 has been activated, and whether or not the initial voltage V0 at time t0 is within a given range. Step S200 yields NO when the air-fuel ratio sensor 420 is inactive, or when the initial voltage V0 is outside the given range (for instance, when V0 is not within a range from 3.0 to 4.0 V). Alternatively, conditions relating to atmospheric pressure or engine water temperature may be further established in step S200.

When step S100 or S200 yields NO, the ECU 200 proceeds to step S600, and sets non-execution for the responsiveness diagnosis of the air-fuel ratio sensor. On the other hand, the ECU 200 proceeds to step S300 when both step S100 and S200 yield YES. In step S300 there is executed a calculation process of a responsiveness diagnosis parameter P(k) of a current (k-th, k: natural number) responsiveness diagnosis.

Figure 8:
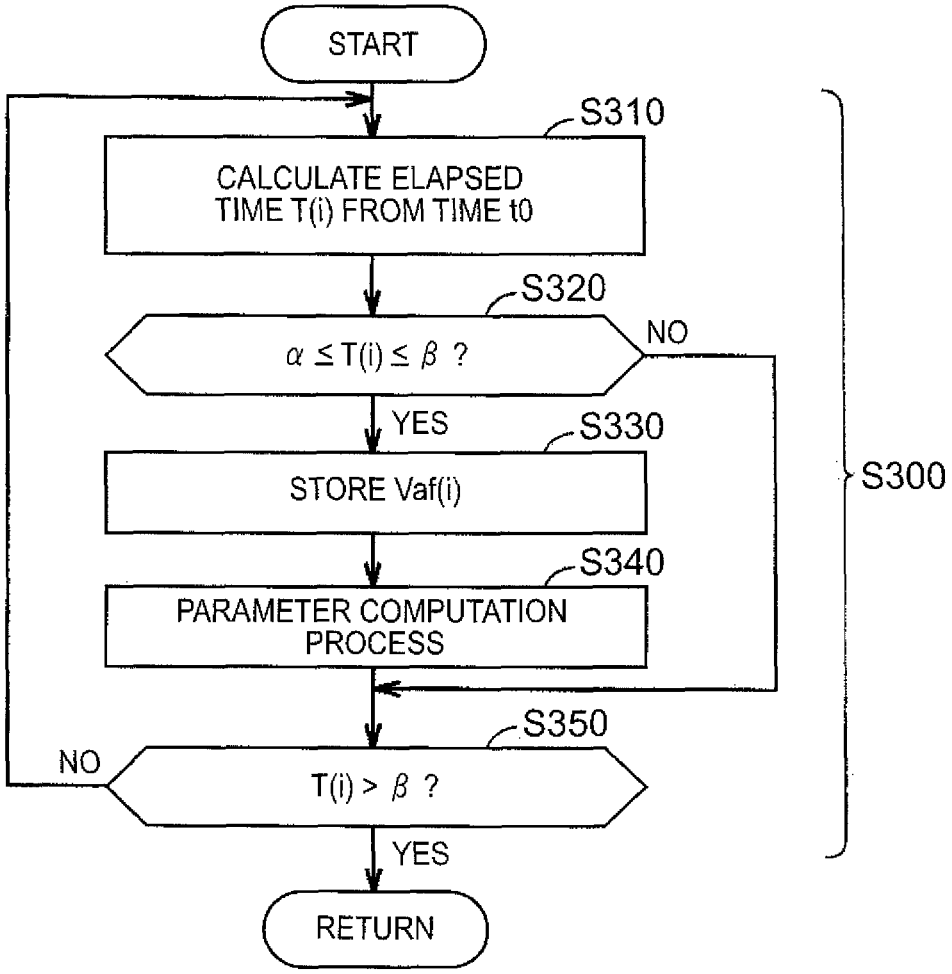
FIG. 8 is a flowchart for explaining a subroutine for a calculation process of a responsiveness diagnosis parameter illustrated in FIG. 7.

FIG. 8 is a flowchart for explaining a subroutine for a responsiveness diagnosis parameter calculation process in step S300 of FIG. 7.

With reference to FIG. 8, upon execution of step S300, the ECU 200 calculates, in step S310, an elapsed time T(i) from the point in time at which the condition of step S100 is met. For instance, the elapsed time since time t0 illustrated in FIG. 5 and FIG. 6 is counted on the basis of a count value of a timer not shown.

In step S320, the ECU 200 compares the elapsed time T(i) calculated in step S310 with an elapsed time α (collective term for α1, α2) and β (collective term for β1, β2) that define the predefined period tα to tβ of FIG. 5 or FIG. 6. As a result it is determined whether the current timing lies within the predefined period tα to tβ illustrated in FIG. 5 or FIG. 6.

When α≤T(i)≤β (YES in S320), the ECU 200 samples the sensor voltage Vaf(i) at the current timing, and stores the result in step S330. Herein, Vaf(i) denotes an i-th (i: natural number) sensor voltage Vaf stored within a predefined period.

In step S340, the ECU 200 executes a parameter computation process. Table 1 sets forth candidates of parameters that are calculated in the parameter computation process in step S340. In the responsiveness diagnosis of an air-fuel ratio sensor according to the present embodiment there is calculated, as the responsiveness diagnosis parameter P(k), at least any one of the plurality of parameters given in Table 1.

TABLE 1

| P(k) | Computation process |
|---|---|
| Locus length | A(i) = A(i − 1) + \|Vaf(i) − Vaf(i − 1)\| |
| Average slope | dV = (Vaf(L) − Vaf(1))/(β − α) |
| Maximum slope | dVmax = MAX[Vaf(i) − Vaf(i − 1)]/ΔT |
| Voltage integrated value | S(i) = S(i − 1) + Vaf(i) |
| Voltage integrated value (difference) | S(i) = S(i − 1) + (Vaf(i) − V0) |

With reference to Table 1, a locus length A, an average slope dV within a predefined period (tα to tβ), a maximum slope dVmax, or a voltage integrated value S, of the sensor voltage Vaf, can be used as the responsiveness diagnosis parameter P(k).

The locus length A(i) can be worked out through computation according to Expression (1), on the basis of the sensor voltage Vaf(i). Herein, initial value A(0)=0 holds for i=1.

$$A(i)=A(i-1)+|Vaf(i)-Vaf(i-1)| \tag{1}$$

The locus length A(i) corresponds to the integrated value of the change amount between samplings of the sensor voltage Vaf. The locus length A(i) is sequentially updated during the predefined period (tα to tβ). The locus length A(i) at the time when the predefined period is over (T(i)=β) is set as the responsiveness diagnosis parameter P(k) in the current (k-th) responsiveness diagnosis.

The average slope dV is given by Expression (2) below, using the sensor voltage Vaf(1) at the beginning of a predefined period (i.e. T(i)=α) and the sensor voltage Vaf(L) at the beginning of a predefined period (i.e. T(i)=β). The average slope dV can be calculated when the predefined period is over.

$$dV=(Vaf(L)-Vaf(1))/\beta-\alpha) \tag{2}$$

The maximum slope dVmax is given by Expression (3) below where ΔT is the sampling period.

$$dV\max=\mathrm{MAX}[(Vaf(i)-Vaf(i-1)]/\Delta T \tag{3}$$

The maximum slope dVmax allows determining a maximum value when the predefined period is over (T(i)=β), on the basis of a Vaf(i)−Vaf(i−1))/ΔT worked out at each sampling.

The voltage integrated value S(i) can be worked out through computation according to Expression (4) below on the basis of the sensor voltage Vaf(i). Herein, initial value S(0)=0 holds for i=1.

$$S(i)=S(i-1)+Vaf(i) \tag{4}$$

Alternatively, the voltage integrated value S(i) can be worked out through computation according to Expression (5) below, using a difference with respect to the initial voltage V0.

$$S(i)=S(i-1)+(Vaf(i)-V0) \tag{5}$$

The voltage integrated value S(i) is sequentially updated during the predefined period (tα to tβ), and the voltage integrated value S(i) at the time when the predefined period is over (T(i)=β) is set as the responsiveness diagnosis parameter P(k) in the current (k-th) responsiveness diagnosis.

With reference again to FIG. 8, the ECU 200 sets non-execution for the process of step S330 and S340 when α≤T(i)≤β does not hold (NO in S320). The ECU 200 further determines in step S350 whether or not T(i)>β.

When T(i)≤β (NO in S350), the ECU 200 returns the process to step S310 in accordance with the progress of the sampling period (ΔT) of the sensor voltage Vaf(i). As a result, the process from step S310 to S340 is repeatedly executed every ΔT until the predefined period is over (T(i)=β).

On the other hand, the ECU 200 terminates the subroutine process illustrated in FIG. 8 when T(i)>β, i.e. when the predefined period (tα to tβ) is over (YES in S350). Accordingly, the process proceeds to step S400 in FIG. 7. Upon completion of the subroutine process illustrated in FIG. 8 at least any one of the plurality of parameters given in Table 1 is calculated on the basis of the sensor voltage Vaf(i) in the predefined period (tα to tβ).

With reference again to FIG. 7, in step S400 the ECU 200 executes a diagnosis process and/or learning process based on the responsiveness diagnosis parameter P(k) obtained in the current (k-th) responsiveness diagnosis, using the parameter calculated in step S300.

In step S400, for instance, the occurrence or absence of a malfunction in the air-fuel ratio sensor 420 is diagnosed through a comparison between the responsiveness diagnosis parameter P(k) and a predefined determination reference value. Alternatively, a learning value is updated according to a learning process (for instance, a filter process) of a current learning value and the current responsiveness diagnosis parameter P(k), in a case where the learning value that is based on the responsiveness diagnosis parameter is used for output compensation in the air-fuel ratio sensor 420.

Thus, the responsiveness diagnosis parameter P(k) calculated through responsiveness diagnosis of an air-fuel ratio sensor according to the present embodiment can be arbitrarily used in, for instance, malfunction detection or output value compensation of the air-fuel ratio sensor 420. Parameters other than those given in Table 1 can be used as the responsiveness diagnosis parameter P(k), so long as the parameters are based on the sensor voltage Vaf.

In step S450, the ECU 200 counts up a responsiveness diagnosis count (k) of the air-fuel ratio sensor. A history of the responsiveness diagnosis parameter can be managed by managing the responsiveness diagnosis parameter P(k) for each execution of responsiveness diagnosis.

In the vehicle according to the present embodiment, thus, responsiveness diagnosis of the air-fuel ratio sensor 420 can be executed on the basis of the behavior of the sensor voltage Vaf resulting from detecting exhaust at the time when the engine 10 rotates with fuel injection in a discontinued state. In this case, the air-fuel ratio changes to a leaner ratio without including fluctuations derived from combustion variability. Therefore, the responsiveness of the air-fuel ratio sensor 420 can be accurately diagnosed by properly setting the period over which the sensor voltage Vaf is monitored. Unlike in JP-2008-95627 A, responsiveness diagnosis of the air-fuel ratio sensor exerts no influence on the output of the engine 10.

Responsiveness diagnosis of the air-fuel ratio sensor according to the present embodiment can be suitably executed from the viewpoint of the degree of activity of the air-fuel ratio sensor and from the viewpoint of securing a period that allows for monitoring, upon restart after intermittent stopping of the hybrid vehicle the engine whereof is operated intermittently, or at engine restart in an ordinary vehicle provided with an idle stop function.

The responsiveness diagnosis parameter P(k) may be switched in accordance with the state at the time of response diagnosis. For instance, the voltage integrated value (difference from initial voltage V0) is useful for quantitative responsiveness diagnosis under a condition of equalized initial voltage V0. In contrast, the change amount of the output of the air-fuel ratio sensor 420 can be quantitatively determined to a certain degree, on the basis of the locus length, when the initial voltage V0 does not lie within the given range. Therefore, the voltage integrated value can be used as the responsiveness diagnosis parameter P(k) when the initial voltage V0 of the sensor voltage Vaf lies within a first voltage range (for instance, 3.2 to 3.5 V). On the other hand, the locus length can be used as the responsiveness diagnosis parameter P(k) when the initial voltage V0 lies outside the first voltage range. In this case, it is preferable to set separately, for each parameter, the determination reference value and the learning value for diagnosis.

Embodiment 2 is explained next. The output behavior of the air-fuel ratio sensor 420 may change in accordance with the crank angle at the point in time of engine startup, in a case where responsiveness diagnosis of the air-fuel ratio sensor explained in Embodiment 1 is executed at engine startup. If the crank angle is different, specifically, the behavior of the sensor voltage Vaf may change as a result of changes in the angle for which exhaust strikes the air-fuel ratio sensor 420. The behavior of the sensor voltage Vaf may change also as a result of a change in the intake distribution in the cylinders at the time of engine startup in accordance with the crank angle. As a result, the responsiveness diagnosis parameter P(k) may exhibit fluctuations depending on the crank angle of at the point in time at which engine startup is initiated.

Figure 9:
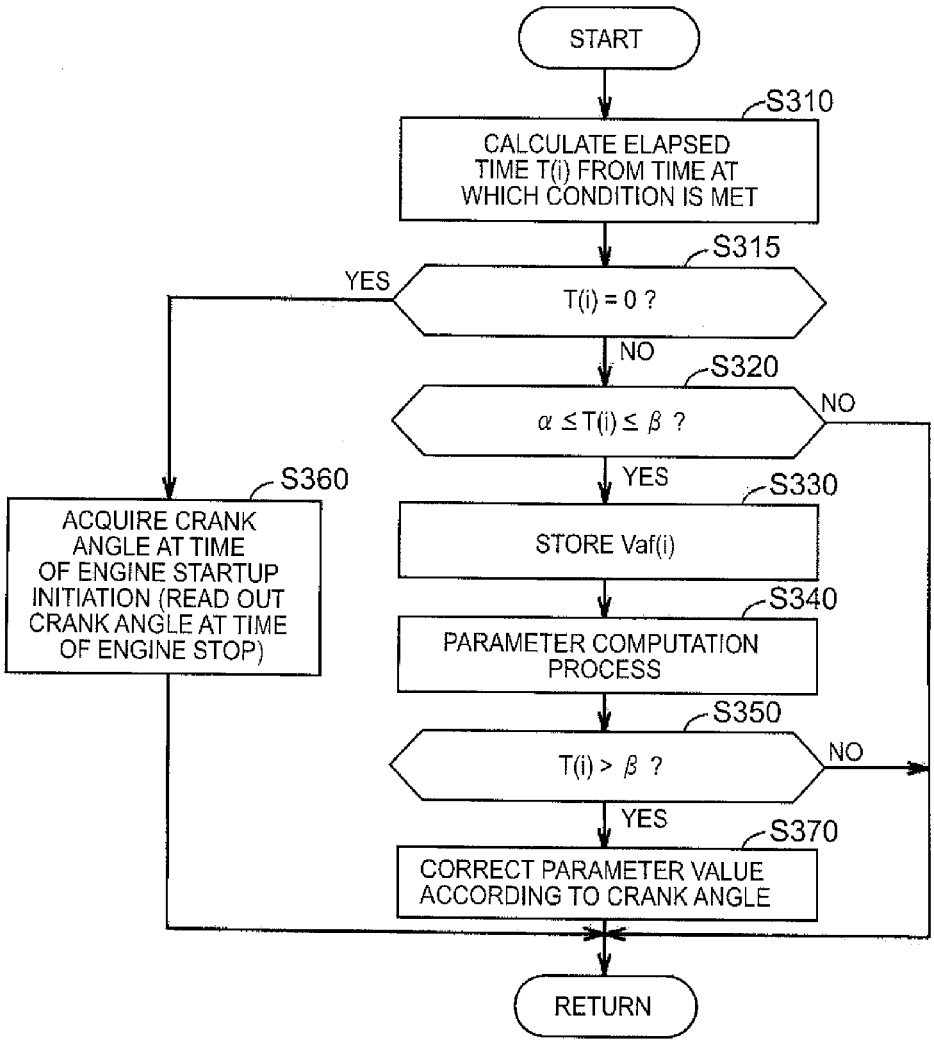
FIG. 9 is a flowchart for explaining a subroutine for a calculation process of a responsiveness diagnosis parameter in responsiveness diagnosis of an air-fuel ratio sensor according to Embodiment 2.

In Embodiment 2, therefore, the subroutine that is executed in step S300 of the process of FIG. 7 is modified to the content illustrated in FIG. 9, in responsiveness diagnosis of an air-fuel ratio sensor of a vehicle explained in Embodiment 1. Otherwise, the process is identical to that of responsiveness diagnosis of an air-fuel ratio sensor of a vehicle according to Embodiment 1, and a detailed explanation thereof will not be repeated herein.

FIG. 9 is a flowchart for explaining a subroutine for a calculation process (S300) of a responsiveness diagnosis parameter in responsiveness diagnosis of an air-fuel ratio sensor according to the present Embodiment 2.

With reference to FIG. 9, in the response diagnosis of an air-fuel ratio sensor according to Embodiment 2 step S310 identical to that of FIG. 8 is executed upon execution of step S300. In step S310, specifically, there is calculated an elapsed time T(i) from the point in time at which the condition of step S100 is met. After step S310, the process proceeds to step S315, and it is determined whether or not the elapsed time is a responsiveness diagnosis startup time.

For instance, the ECU 200 determines YES when T(i)=0 (first process), and executes the process of step S360. In step S360, the ECU 200 acquires a crank angle at the time when engine startup is initiated.

For instance, the ECU 200 calculates and stores the crank angle at the time when the engine 10 is stopped. In step S360, the crank angle at the time when engine startup is initiated can be acquired through reading of the stored crank angle.

In the hybrid vehicle 1 illustrated in FIG. 1, for instance, the crank angle can be detected in the below-described manner. The crank position sensor 11 (FIG. 1) for detection of the crank angle may be configured in the form of an electromagnetic pickup sensor. Accordingly, it is difficult to accurately detect the crank angle in a region of low engine revolutions. In the hybrid vehicle illustrated in FIG. 1, it is possible to trace the crank angle (revolutions) of engine 10 also for a low-speed region in which detection by an electromagnetic pickup sensor is difficult, according to the relationship of the collinear diagram illustrated in FIG. 2, on the basis of the gear ratio at the power split mechanism 40 and the outputs of the first resolver 12 and the second resolver 13 that are respectively provided in the first MG 20 and the second MG 30. Therefore, the crank angle at a time when the engine is stopped can be calculated on the basis of a final value that could be detected by the crank position sensor 11 (electromagnetic pickup sensor) and on the basis of subsequent outputs of the first resolver 12 and the second resolver 13. The calculation of the crank angle at the time when startup of the engine 10 is initiated is not limited to the above-described calculation, and the crank angle may be calculated by resorting to other mechanisms and computations.

From launching of responsiveness diagnosis onwards (NO in S315), the ECU 200 executes the parameter computation process on the basis of the sensor voltage Vaf(i) sampled within the predefined period (tα to tβ), according to steps S320 to S350 identical to those of FIG. 8.

When the predefined period is over (T(i)=β), the ECU 200 determines YES in step S350, and the process proceeds to step S370. In step S370, the ECU 200 corrects the parameter value as finally worked out in step S340, in accordance with the crank angle at the time when engine startup is initiated.

For instance, a map is created in which a correction value ΔP is worked out beforehand for each crank angle; thereby, ΔP can be determined by referring to the map, in accordance with the crank angle at the time when engine startup is initiated, as worked out in step S370. As a result, a parameter value after correction (P+ΔP) is ultimately obtained for the parameter value P that is worked out in step S340.

The control process according to the flowchart illustrated in FIG. 7 yields as a result a responsiveness diagnosis parameter P(k)=P+ΔP. The process thereafter is identical to that of FIG. 7, and a detailed explanation thereof will not be repeated.

Thus, the responsiveness diagnosis of an air-fuel ratio sensor according to Embodiment 2 allows curtailing fluctuation of the responsiveness diagnosis parameter P(k) that are derived from changes in the behavior of the sensor voltage Vaf depending on the crank angle at the time when engine startup is initiated. As a result, the responsiveness diagnosis parameter P(k) can be accurately calculated according to the output characteristic of the air-fuel ratio sensor 420, and hence it becomes possible to increase the precision of the responsiveness diagnosis of an air-fuel ratio sensor that is executed at engine startup. In particular, it becomes possible to suppress misdetection of a malfunction in the air-fuel ratio sensor 420 depending on the crank angle at the time when engine startup is initiated.

Embodiment 3 is explained next. In Embodiment 3 a process is explained in which a diagnosis content is switched in accordance with the history of responsiveness diagnosis of an air-fuel ratio sensor.

Figure 10:
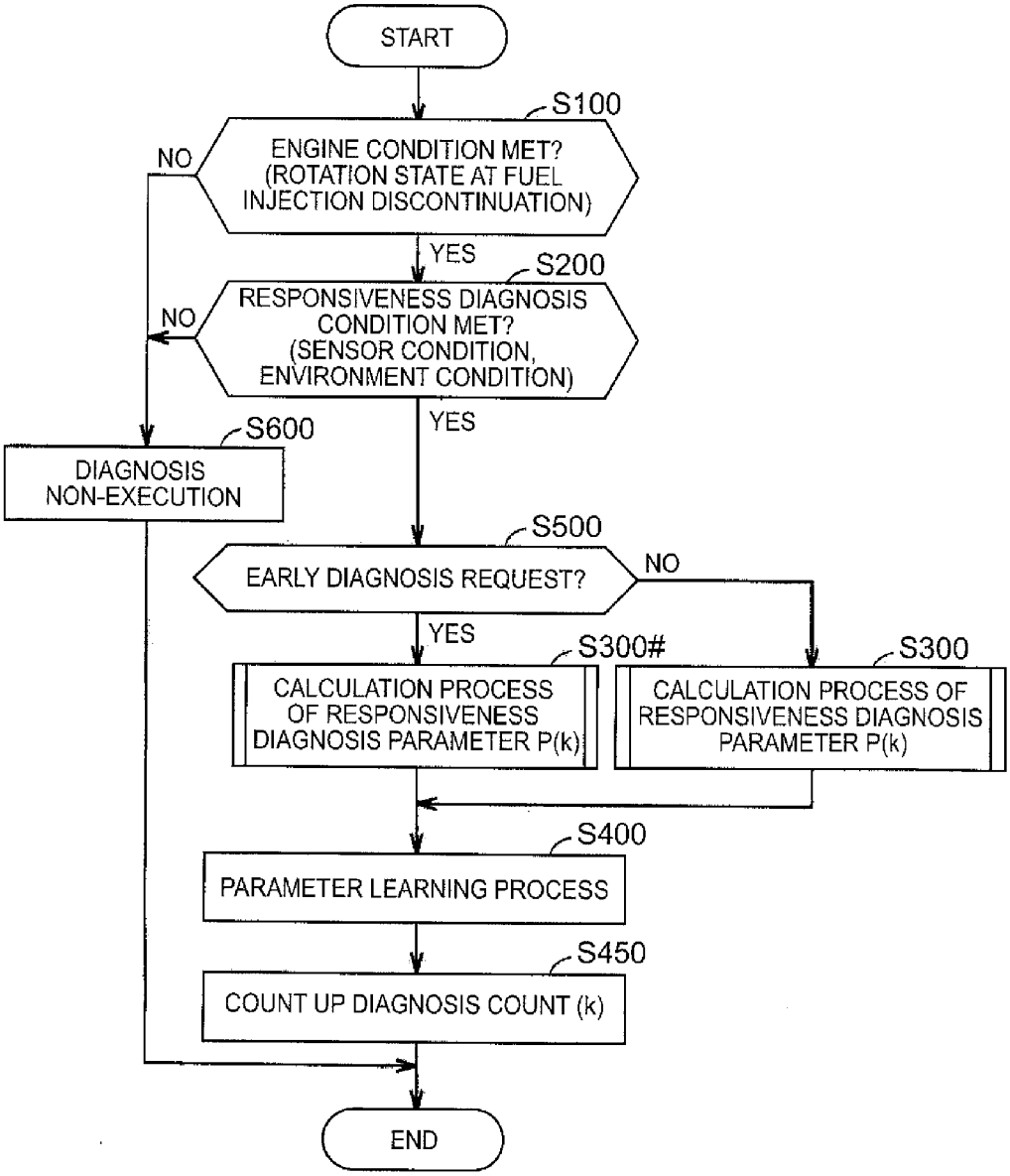
FIG. 10 is a flowchart illustrating a control process procedure for responsiveness diagnosis of an air-fuel ratio sensor according to Embodiment 3.

FIG. 10 is a flowchart for explaining a control process of responsiveness diagnosis of an air-fuel ratio sensor according to Embodiment 3 of the invention.

With reference to FIG. 10, step S100 and S200 identical to those of FIG. 7 yield YES in the responsiveness diagnosis of an air-fuel ratio sensor according to Embodiment 3. Herein, step S500 is executed before the calculation process of the responsiveness diagnosis parameter of step S300.

In step S500 the ECU 200 determines, on the basis of the history of responsiveness diagnosis thus far, whether or not the content of the parameter computation process needs to be changed. For instance, the ECU 200 determines, in step S500, whether early diagnosis of the air-fuel ratio sensor 420 is necessary or not.

Figure 11:
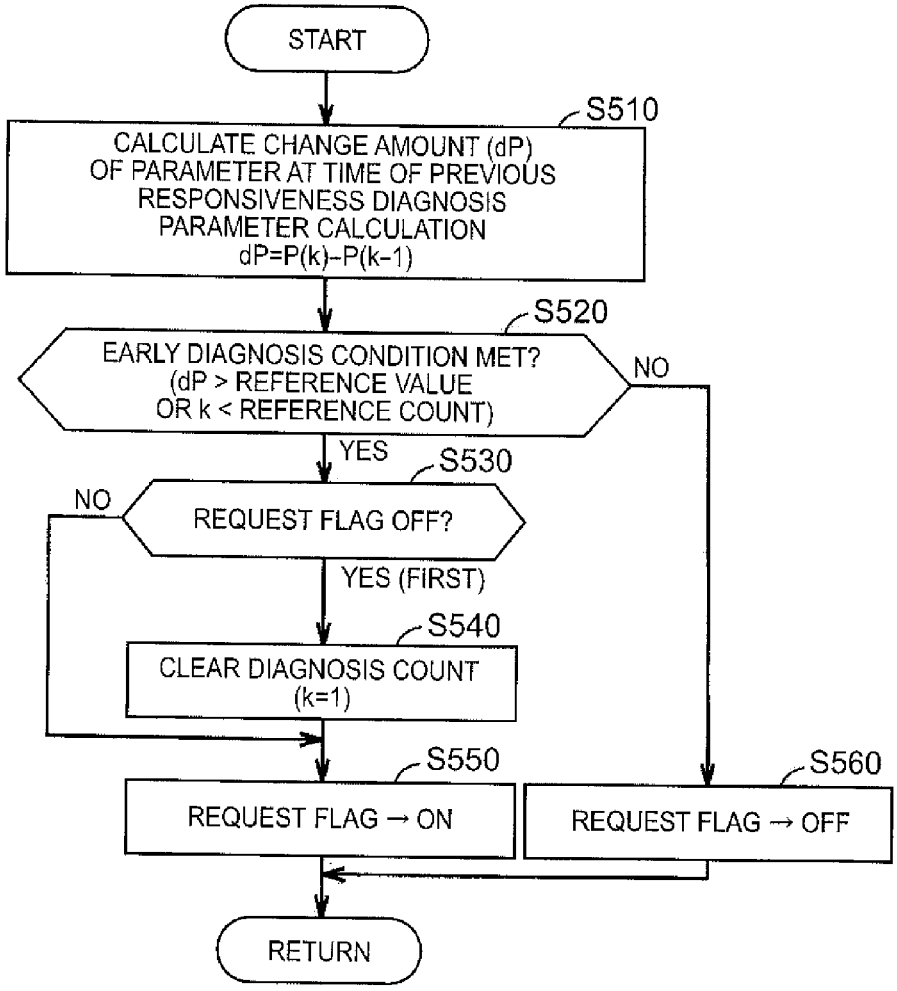
FIG. 11 is a flowchart for explaining an example of a process of determining the need for early diagnosis in responsiveness diagnosis of an air-fuel ratio sensor according to Embodiment 3.

FIG. 11 is a flowchart for explaining an example of the process for determining the need for early diagnosis in step S500 of FIG. 10.

With reference to FIG. 11, the ECU 200 calculates, in step S510, a change amount dP of the responsiveness diagnosis parameter P(k) that is calculated in a previous responsiveness diagnosis. That is, dP is defined as dP=P(k)−P(k−1).

In step S520, the ECU 200 determines whether an early diagnosis condition is met or not. For instance, step S520 yields YES when the parameter change amount dP worked out in step S510 is greater than a reference value, i.e. when the responsiveness diagnosis parameter changes significantly.

If step S520 yields NO, the ECU 200 proceeds to step S560. In step S560, a request flag of early diagnosis is turned off. On the other hand, if step S520 yields YES, the ECU 200 proceeds to step S530. In step S530, the ECU 200 determines whether the request flag of early diagnosis is off or not. If step S520 yields YES with the request flag in an off state (YES in S530), i.e. it is the first time that the determination result of step S520 is changed over from NO to YES, the ECU 200 clears a diagnosis count k in step S540 (k−1). The diagnosis count k is also cleared in cases of system initialization on account of battery replacement or the like.

On the other hand, if step S520 yields YES after the request flag has been turned on (NO in S530), the process of step S540 is skipped. In step S550, the ECU 200 turns on the request flag of early diagnosis, regardless of the determination result in step S530.

As a result of the series of processes illustrated in FIG. 11, the request flag of early diagnostic is turned on in response to a significant change in the responsiveness diagnosis parameter, or in response to initialization from battery clearing or the like. The request flag of early diagnosis is maintained at on so long as the change amount after the request flag has been turned on has a value no greater than a predefined value, over a reference lapse of time, or until the diagnosis count reaches a reference number of times.

With reference again to FIG. 10, when the request flag of early diagnosis is turned off (NO in S500), the ECU 200 executes a calculation process of the responsiveness diagnosis parameter P(k) in step S300 identical to that of Embodiment 1. On the other hand, when the request flag of early diagnosis is turned on (YES in S500), the ECU 200 calculates the responsiveness diagnosis parameter P(k) in step S300#, in which a process is executed that is different from that of step S300.

Figure 12:
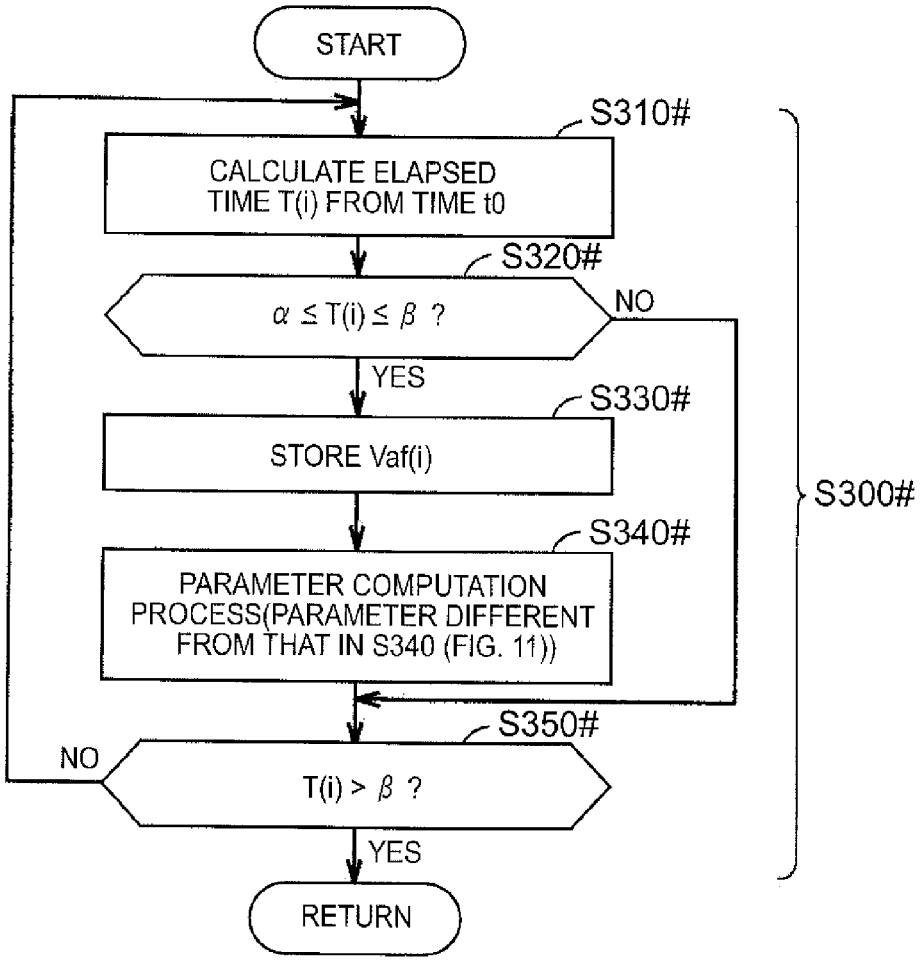
FIG. 12 is a flowchart for explaining an example of a subroutine for a calculation process of a responsiveness diagnosis parameter upon request of early diagnosis.

FIG. 12 is a flowchart for explaining an example of a subroutine for a calculation process (S300#) of a responsiveness diagnosis parameter upon request of early diagnosis. The process in step S300 is identical to that of the subroutine illustrated in FIG. 8.

With reference to FIG. 12, the ECU 200 executes the process from steps S310# to S350# upon execution of step S300#. Herein, steps S310# to S330# and S350# are identical to steps S310 to S330 and S350 of FIG. 8, respectively. The ECU 200 executes in step S340# the parameter computation process, on the basis of the sensor voltage Vaf(i), within a predefined period tα to tβ of FIG. 5 or FIG. 6. In step S340#, the ECU 200 executes a computation process of a parameter different from that of step S340 of FIG. 8.

In the example illustrated in FIG. 12, as a result, a different parameter is calculated, as the responsiveness diagnosis parameter P(k), from among the plurality of parameters given in Table 1, between early diagnosis request and normal diagnosis request (other than early diagnosis request). For instance, upon normal diagnosis request, the voltage integrated value or locus length is used as the responsiveness diagnosis parameter P(k), for the purpose of avoiding misdetection of malfunctions, or for the purpose of quantitative responsiveness diagnosis. Upon early diagnosis request, by contrast, the average slope or maximum slope can be used as the responsiveness diagnosis parameter P(k), in order to determine, at the macro level, the occurrence or absence of a malfunction.

Figure 13:
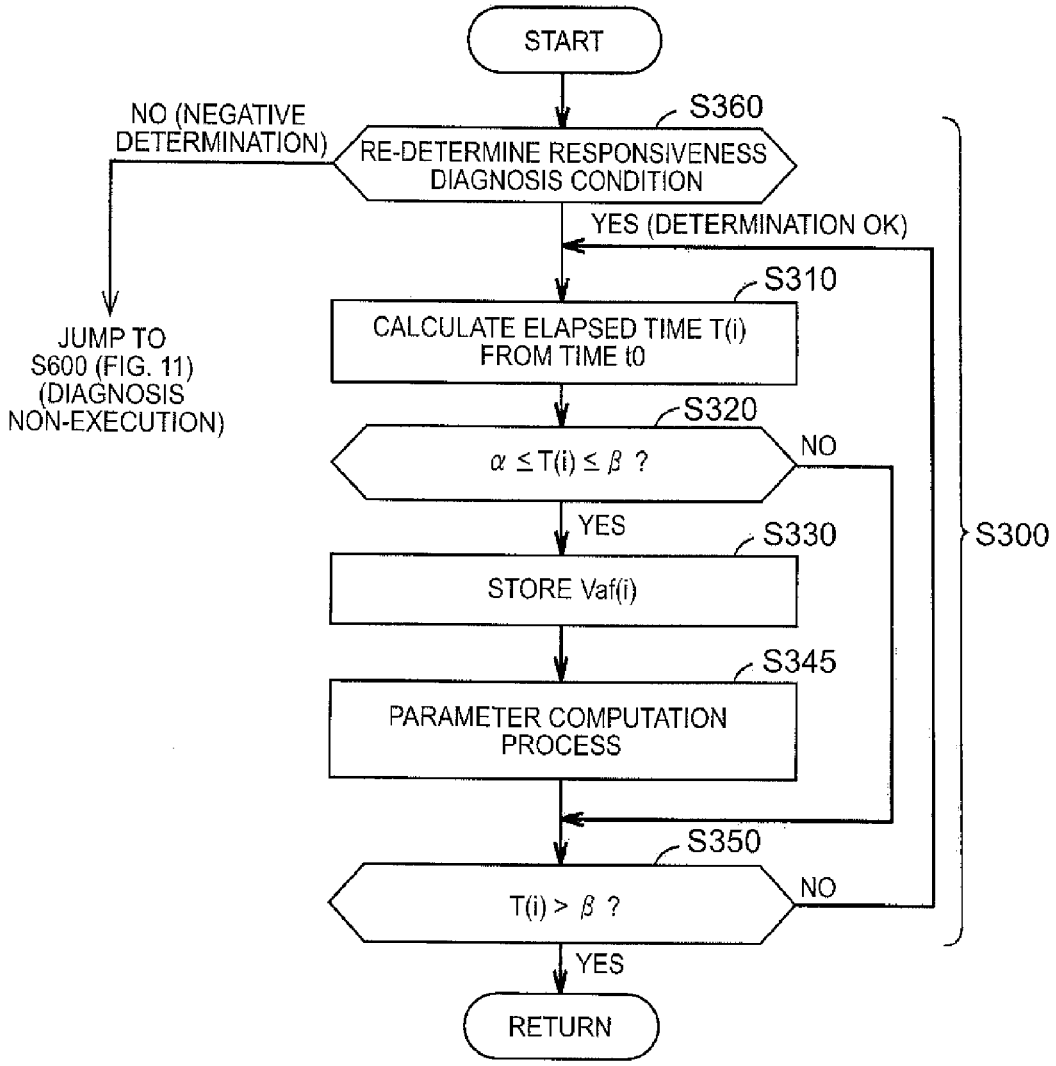
FIG. 13 is a flowchart for explaining an example, of a subroutine for a calculation process of a responsiveness diagnosis parameter in ordinary responsiveness diagnosis.

Alternatively, there may be altered the calculation process of the responsiveness diagnosis parameter of responsiveness diagnosis upon normal diagnosis request, as illustrated in FIG. 13. In this case, the process of step S300# may be set to be identical to that of the subroutine illustrated in FIG. 8.

FIG. 13 is a flowchart for explaining an example of a subroutine for a calculation process (S300) of a responsiveness diagnosis parameter in responsiveness diagnosis upon normal diagnosis request.

With reference to FIG. 13, the ECU 200 executes, in step S360, re-determination of a responsiveness diagnosis condition determined in step S200, upon execution of step S300. The ECU 200 executes the process of step S360 prior to the process of step S310 to S350. Re-determination in step S360 is executed under a more stringent condition than that in the determination in step S200.

For instance, responsiveness diagnosis is permitted in step S200 (YES determination), if the initial voltage V0 lies within a range of 3.0 to 4.0 V. In step S360, by contrast, responsiveness diagnosis is permitted (YES determination) if the initial voltage V0 lies within a range from 3.2 to 3.5 V.

Upon negative determination in step S360, the ECU 200 moves the process on to step S600, and sets non-execution for the responsiveness diagnosis of an air-fuel ratio sensor. Upon affirmative determination in step S360, on the other hand, the ECU 200 executes, in steps S310 to S350 identical to those of FIG. 8, a parameter computation process on the basis of the sensor voltage Vaf(i) within the predefined period tα to tβ of FIG. 5 or FIG. 6.

In the example of FIG. 13, as a result, it becomes possible to relax the permission condition (for instance, range of the initial voltage V0) of responsiveness diagnosis upon request of early diagnosis, in order to give priority to opportunity assurance of responsiveness diagnosis. On the other hand, upon normal diagnosis request, the permission condition of responsiveness diagnosis can be made more stringent by giving priority to increasing the precision of the responsiveness diagnosis. In this case, a parameter shared by step S300 and S300# may be used as the responsiveness diagnosis parameter P(k).

The subroutines illustrated in FIG. 12 and FIG. 13 may be further combined with correction of the responsiveness diagnosis parameter value according to the crank angle, as applied in Embodiment 2. In that case, it is sufficient to add the process of steps S315, S360, S370 illustrated in FIG. 9 to the subroutines of FIG. 12 and FIG. 13.

A combination of the features of FIG. 12 and FIG. 13 makes it possible to relax the permission condition of responsiveness diagnosis to a less stringent condition than upon normal diagnosis request, and to calculate a parameter different from a parameter that is used upon normal diagnosis request, as the responsiveness diagnosis parameter P(k) upon request of early diagnosis. For instance, the V0 condition can be made stricter, and the voltage integrated value can be used as the responsiveness diagnosis parameter P(k), in order to achieve a more precise diagnosis, upon request of normal diagnosis. By contrast, the V0 condition can be eased, and the locus length can be used as the responsiveness diagnosis parameter P(k), in order to secure diagnosis opportunity, upon request of early diagnosis.

As explained above, responsiveness diagnosis of an air-fuel ratio sensor of a vehicle according to Embodiment 3 allows discriminating sharply between situations in which securing responsiveness diagnosis is to be given priority, and situations in which precision of responsiveness diagnosis is to be given priority, in accordance with the history of past responsiveness diagnoses. Therefore, responsiveness diagnosis of the air-fuel ratio sensor of the vehicle according to Embodiment 3 allows executing responsiveness diagnosis according to a content that is appropriate for each situation, when an engine state is brought about in which responsiveness diagnosis can be executed.

The disclosed embodiments are exemplary in character in all features, and must be regarded as non-limiting. The scope of the invention is defined not by the above description but by the appended claims. The invention is meant to cover all equivalents and modifications that fall within the scope of the claims.

What is claimed is:

1. A vehicle, comprising:

an internal combustion engine;

an air-fuel ratio sensor provided in an exhaust passage of the internal combustion engine;

a controller configured to diagnose a responsiveness of the air-fuel ratio sensor based on an output voltage of the air-fuel ratio sensor in a predefined period, the predefined period being a period over which exhaust gas goes through the air-fuel ratio sensor while the internal combustion engine is rotating without fuel injection;

an electric motor configured to start up the internal combustion engine; and an angle acquisition device that acquires a crank angle at a time at which startup of the internal combustion engine is initiated, wherein;

the controller is configured to perform control in such a manner that the internal combustion engine operates intermittently in accordance with a vehicle state while the vehicle is traveling, and the controller is configured to diagnose the responsiveness based on the output voltage of the air-fuel ratio sensor in the predefined period corresponding to a period from the internal combustion engine is stopped to the fuel injection is initiated, when the internal combustion engine is started up by the electric motor from a state of being stopped while the vehicle is traveling, the controller is configured to correct a result of diagnosis of the responsiveness obtained at the time of startup of the internal combustion engine, in accordance with the crank angle acquired b the angle acquisition device.

2. A vehicle, comprising:

an internal combustion engine;

an air-fuel ratio sensor provided in an exhaust passage of the internal combustion engine;

a controller configured to diagnose a responsiveness of the air-fuel ratio sensor based on an output voltage of the air-fuel ratio sensor in a predefined period, the predefined period being a period over which exhaust gas goes through the air-fuel ratio sensor while the internal combustion engine is rotating without fuel injection;

an electric motor that starts up the internal combustion engine; and an angle acquisition device that acquires a crank angle at a time at which startup of the internal combustion engine is initiated, wherein:

the controller is configured to diagnose the responsiveness based on the output voltage of the air-fuel ratio sensor in the predefined period corresponding to a period from the internal combustion engine is started up to the fuel injection is initiated, upon startup of the internal combustion engine by the electric motor from a stopped state, and the controller is configured to correct a result of diagnosis of the responsiveness obtained at the time of startup of the internal combustion engine, in accordance with the crank angle acquired by the angle acquisition device.

3. A vehicle, comprising:

an internal combustion engine;

an air-fuel ratio sensor provided in an exhaust passage of the internal combustion engine; and a controller configured to diagnose a responsiveness of the air-fuel ratio sensor based on an output voltage of the air-fuel ratio sensor in a predefined period, the predefined period being a period over which exhaust gas goes through the air-fuel ratio sensor while the internal combustion engine is rotating without fuel injection, wherein:

the controller is configured to calculate, upon diagnosis of the responsiveness, at least any one of a locus length, an average slope, a maximum slope and an integrated value, of the output voltage of the air-fuel ratio sensor in the predefined period, as a parameter that denotes the responsiveness, the controller is configured to calculate, as the parameter, the integrated value of the output voltage, in a case where an initial voltage, being an output voltage of the air-fuel ratio sensor obtained at the time at which diagnosis of the responsiveness is initiated, lies within a first voltage range, and the controller is configured to calculate, as the parameter, the locus length of the output voltage in a case where the initial voltage lies outside the first voltage range.

4. A vehicle, comprising:

an internal combustion engine;

an air-fuel ratio sensor provided in an exhaust passage of the internal combustion engine; and a controller configured to diagnose a responsiveness of the air-fuel ratio sensor based on an output voltage of the air-fuel ratio sensor in a predefined period, the predefined period being a period over which exhaust gas goes through the air-fuel ratio sensor while the internal combustion engine is rotating without fuel injection, wherein the controller is configured to diagnose the responsiveness when a predefined condition is met upon initiation of the diagnosis, and the controller is configured to modify the predefined condition in accordance with a history up to a previous result of diagnosis of the responsiveness.

5. A vehicle, comprising:

an internal combustion engine;

an air-fuel ratio sensor provided in an exhaust passage of the internal combustion engine; and a controller configured to diagnose a responsiveness of the air-fuel ratio sensor based on an output voltage of the air-fuel ratio sensor in a predefined period, the predefined period being a period over which exhaust gas goes through the air-fuel ratio sensor while the internal combustion engine is rotating without fuel injection, wherein the controller is configured to calculate, upon diagnosis of the responsiveness, at least any one of a locus length, an average slope, a maximum slope and an integrated value, of the output voltage of the air-fuel ratio sensor in the predefined period, as a parameter that denotes the responsiveness, and the controller is configured to modify the calculated parameter in accordance with a history up to a previous result of diagnosis of the responsiveness.

6. A method for controlling a vehicle, comprising:

diagnosing a responsiveness of an air-fuel ratio sensor based on an output voltage of the air-fuel ratio sensor in a predefined period, the predefined period is a period over which exhaust gas goes through the air-fuel ratio sensor during an internal combustion engine is rotating without fuel injection;

intermittently operating the internal combustion engine in accordance with a vehicle state while the vehicle is traveling;

diagnosing the responsiveness based on the output voltage of the air-fuel ratio sensor in the predefined period corresponding to a period when the internal combustion engine is stopped to the fuel injection is initiated, when the internal combustion engine is started up by the electric motor from a state of being stopped during the vehicle is traveling, acquiring a crank angle at a time at which startup of the internal combustion engine is initiated; and correcting a result of diagnosis of the responsiveness obtained at the time of startup of the internal combustion engine in accordance with the acquired crank angle.

7. A method for controlling a vehicle, comprising:

diagnosing a responsiveness of an air-fuel ratio sensor based on an output voltage of the air-fuel ratio sensor in a predefined period, the predefined period is a period over which exhaust gas goes through the air-fuel ratio sensor during an internal combustion engine is rotating without fuel injection;

diagnosing the responsiveness based on the output voltage of the air-fuel ratio sensor in the predefined period corresponding to a period from the internal combustion engine is started up to the fuel injection is initiated, upon startup of the internal combustion engine by the electric motor from a stopped state;

acquiring a crank angle at a time at which startup of the internal combustion engine is initiated is acquired; and correcting a result of diagnosis of the responsiveness obtained at the time of startup of the internal combustion engine in accordance with the acquired crank angle.

8. A method for controlling a vehicle, comprising:

diagnosing a responsiveness of an air-fuel ratio sensor based on an output voltage of the air-fuel ratio sensor in a predefined period, the predefined period is a period over which exhaust gas goes through the air-fuel ratio sensor during an internal combustion engine is rotating without fuel injection, wherein:

upon diagnosis of the responsiveness, at least any one of a locus length, an average slope, a maximum slope and an integrated value, of the output voltage of the air-fuel ratio sensor in the predefined period, is calculated as a parameter that denotes the responsiveness, the integrated value of the output voltage is calculated as the parameter in a case where an initial voltage, being an output voltage of the air-fuel ratio sensor obtained at the time at which diagnosis of the responsiveness is initiated, lies within a first voltage range, and the locus length of the output voltage is calculated as the parameter in a case where the initial voltage lies outside the first voltage range.

* * * * *